US010113427B1

(12) United States Patent
Davis

(10) Patent No.: US 10,113,427 B1
(45) Date of Patent: Oct. 30, 2018

(54) VANE HEAT ENGINE

(71) Applicant: Brian Davis, Ripon, WI (US)

(72) Inventor: Brian Davis, Ripon, WI (US)

( * ) Notice: Subject to any disclaimer, the term of this patent is extended or adjusted under 35 U.S.C. 154(b) by 227 days.

(21) Appl. No.: 14/669,284

(22) Filed: Mar. 26, 2015

Related U.S. Application Data

(60) Provisional application No. 61/974,353, filed on Apr. 2, 2014.

(51) Int. Cl.

| | |
|---|---|
| ***F03C 2/00*** | (2006.01) |
| ***F03C 4/00*** | (2006.01) |
| ***F04C 2/00*** | (2006.01) |
| ***F01C 1/344*** | (2006.01) |
| ***F01C 21/08*** | (2006.01) |
| ***F04C 2/344*** | (2006.01) |

(52) U.S. Cl.
CPC ..... *F01C 1/344* (2013.01); *F01C 1/3442* (2013.01); *F01C 21/0809* (2013.01); *F01C 21/0836* (2013.01); *F01C 21/0863* (2013.01); *F04C 2/3442* (2013.01); *F04C 2240/30* (2013.01)

(58) Field of Classification Search
CPC ..... F01C 21/0863; F01C 21/0809; F01C 21/0836; F01C 1/344; F01C 1/3442; F04C 2/3446; F04C 18/3564; F04C 2240/10; F04C 2240/20; F04C 2240/30
USPC ..... 418/111, 259, 266–268, 31, 24–25
See application file for complete search history.

(56) References Cited

U.S. PATENT DOCUMENTS

| | | | | |
|---|---|---|---|---|
| 3,084,677 | A | 4/1963 | Mitchell | |
| 3,889,775 | A | 6/1975 | Luscher | |
| 3,890,071 | A | 6/1975 | O'Brien | |
| 4,758,137 | A | 7/1988 | Kieper | |
| 7,931,450 | B2 | 4/2011 | Ueki et al. | |
| 8,118,575 | B2 | 2/2012 | Williamson et al. | |
| 8,545,199 | B2 | 10/2013 | Koller et al. | |
| 8,567,178 | B2 | 10/2013 | Hartfield, Jr. | |
| 2005/0036897 | A1* | 2/2005 | Kasmer | F01C 21/0863 418/31 |
| 2010/0232989 | A1 | 9/2010 | Watanabe et al. | |
| 2012/0000199 | A1* | 1/2012 | Hartfield, Jr. | F01C 1/3442 123/243 |
| 2013/0089446 | A1 | 4/2013 | Williamson et al. | |

* cited by examiner

*Primary Examiner* — Theresa Trieu
(74) *Attorney, Agent, or Firm* — Brannen Law Office, LLC

(57) ABSTRACT

The present invention relates to a vane heat engine and in particular to a vane heat engine efficiently utilizing potential energy and having an adjustable expansion chamber wall so that the volume of the expansion chamber is adjustable. The engine has a housing with an inlet and an outlet. A rotor with a plurality of vanes is provided to rotate within the housing. An adjuster is provided for adjusting the location of an expansion chamber wall. The position or location of the expansion chamber wall determines the volume within a plurality of compartments bound by the rotor, the expansion chamber wall and two of the plurality of vanes. The expansion wall can be made of a plurality of members, whereby the expansion wall is flexible along its longitudinal dimension yet strong perpendicular to the longitudinal dimension.

9 Claims, 14 Drawing Sheets

VANE HEAT ENGINE

This United States utility patent application claims priority on and the benefit of provisional application 61/974,353 filed Apr. 2, 2014, the entire contents of which are hereby incorporated herein by reference.

BACKGROUND OF THE INVENTION

1. Field of the Invention

The present invention relates to a vane heat engine and in particular to a vane heat engine efficiently utilizing potential energy and having an adjustable expansion chamber wall so that the volume of the expansion chamber is adjustable.

2. Description of the Related Art

U.S. Pat. No. 3,084,677 to Mitchell is titled Sliding Vane Type Rotary Steam Engine and relates to improvements in steam engines of the rotary type. U.S. Pat. No. 3,890,071 to O'Brien is titled Rotary Steam Engine. It shows a rotaty steam engine having a cylindrical housing with an eccentrically mounted cylindrical rotor therein. The rotor is provided with reciprocal vanes that are controlled by a fixed cam surface, and the inner surface of the housing has a flat chordal plate extending thereacross through which inlet and outlet passages are provided. The arrangement is such that the chambers between the inner rotor and the housing approximate an involute in order to take full advantage of isentropic expansion.

U.S. Pat. No. 4,758,137 to Kieper is titled Vane Type Variable Displacement Motor. It shows a vane type variable displacement motor comprising a body having an elliptical first bore, end caps with axial bores, an axial drive shaft journaled therethrough and a rotor on the shaft. A plurality of radial vanes are movably mounted upon and around the rotor and are biased toward the first bore and react to pressurized liquid delivered through intake and exhaust passages in the body. Rotative pistons upon the shaft within the end cap bores have a series of radial slots to receive the vanes whereby the pistons are adapted for axial movement relative to the vanes into the first bore for modifying the effective internal volume of the first bore and speed of shaft rotation. Pilot ports in the end caps are connected to a variable pressure source for biasing the pistons variably into the first bore.

U.S. Pat. No. 8,567,178 to Hartfield, Jr. is titled Positive Displacement Rotary Vane Engine. It shows an engine, which includes a positive displacement compression process, a variably fueled, continuous combustor and/or heat exchanger, and a positive displacement, work-producing expander. This arrangement avoids the traditional stochiometric mixture requirements utilized in spark-ignition based engines and the emission problems associated with diesel engines.

While the engines shown in each of these patents may work well for their intended purposes, they each may be improved upon.

Thus there exists a need for a vane heat engine that solves these and other problems.

SUMMARY OF THE INVENTION

The present invention relates to a vane heat engine and in particular to a vane heat engine efficiently utilizing potential energy and having an adjustable expansion chamber wall so that the volume of the expansion chamber is adjustable. The engine has a housing with an inlet and an outlet. A rotor with a plurality of vanes is provided to rotate within the housing. An adjuster is provided for adjusting the location of an expansion chamber wall. The position or location of the expansion chamber wall determines the volume within a plurality of compartments bound by the rotor, the expansion chamber wall and two of the plurality of vanes. The expansion wall can be made of a plurality of members, whereby the expansion wall is flexible along its longitudinal dimension yet strong perpendicular to the longitudinal dimension.

According to one advantage of the present invention, the size and shape of the expansion chamber is variable (as opposed to moving the location of the chamber or rotor).

Related, this advantageously allows the volumes of individual compartments to be sized appropriately to achieve desired compartment pressures at the end of the expansion cycle.

According to another advantage of the present invention, the expansion chamber wall can be made of a plurality of members. This advantageously allows the wall to be radially flexibly along the longitudinal or perimeter dimension of the wall, yet provide for stiffness and strength perpendicular to the wall.

According to another advantage of the present invention, mechanical adjusters can be provided for shaping the expansion chamber wall and providing support to the wall.

According to a further advantage yet of the present invention, one end of the expansion chamber wall is fixed and the other end is not fixed. In this regard, the non-fixed end is able to move relative to the rotor (and also relative to the housing cavity fixed outer wall) thereby increasing or decreasing the cavity volume.

According to a still further advantage of the present invention, as the ratio of input pressure to output pressure changes, the increasing and decreasing cavity size provided by the adjustable expansion chamber wall allows for full expansion of a gas within the cavity so that the pressure within the cavity can be equal or close to equal to the ambient pressure at the point of exhaust thereby increasing engine efficiency.

Related, the members are allowed to slide relative to each other. This allows the distal end (non-fixed end) to have an end profile that seals with the housing cavity fixed outer wall.

This radial flexibility allows each of the members to contact the outer wall to provide a good seal. In an alternative embodiment, one of the members can comprise a seal such as rubber for increased sealing effectiveness.

According to another advantage of the present invention, the rotor is in close proximity to the cavity wall between the outlet and inlet.

According to another advantage of the present invention, the expansion chamber has a radially expanding dimension at the entrance face, and either a constant or a radially expanding volume at the expansion face allowing the engine to efficiently harness potential energy of expanding gas as it causes the rotor to turn.

According to a still further advantage yet of the present invention, spring loaded vanes are operable with the adjustable expansion chamber wall. The spring loaded vanes are operable regardless of the position of the expansion chamber wall.

Other advantages, benefits, and features of the present invention will become apparent to those skilled in the art upon reading the detailed description of the invention and studying the drawings.

DETAILED DESCRIPTION OF PREFERRED EMBODIMENTS

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

Figure 17:
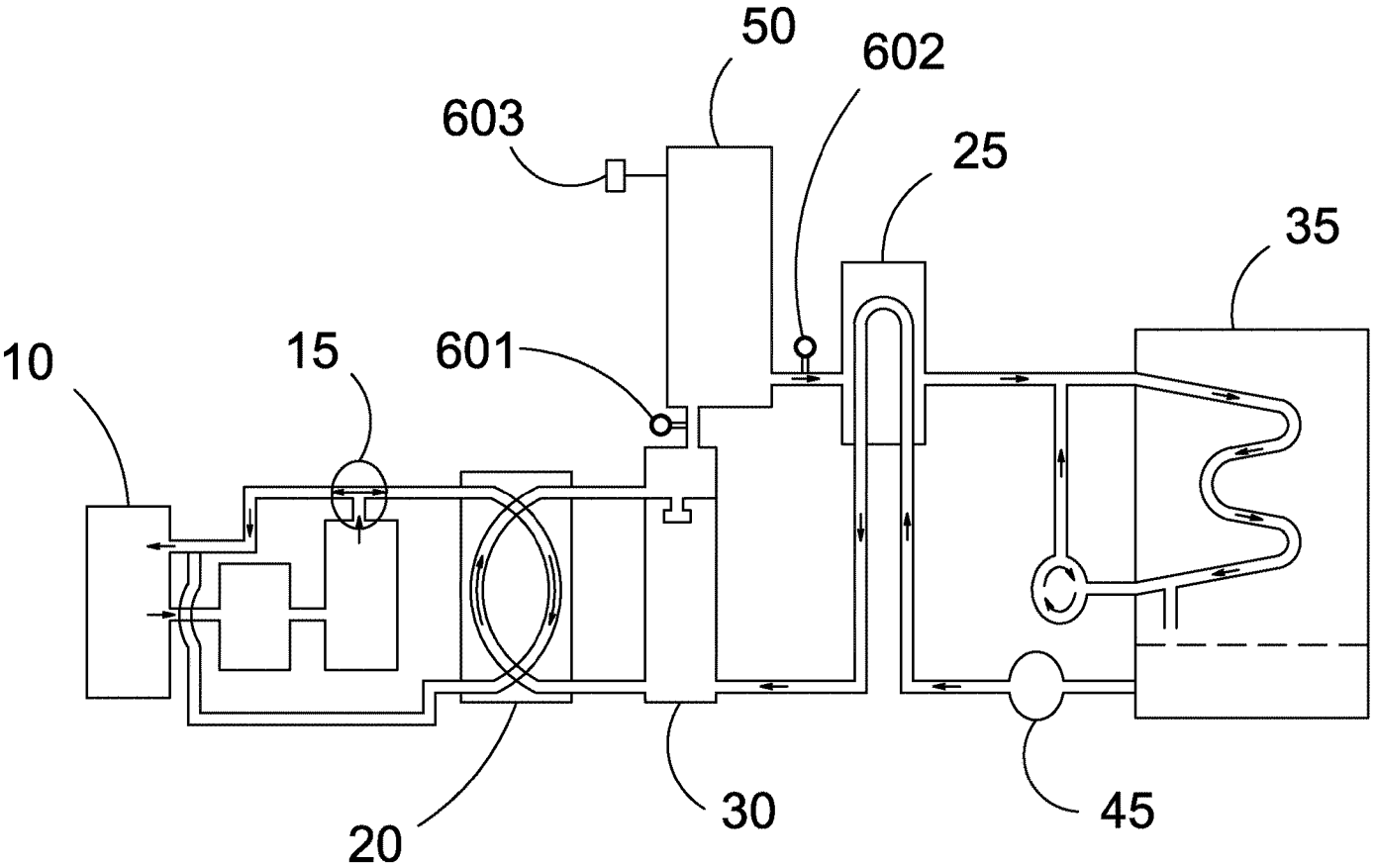
FIG. 17 is a schematic diagram of a system incorporating the present invention.

Looking now to FIG. 17, it is seen that a boiler 10 is provided. The boiler can heat a liquid and force it through a two way valve 15. On one side of the valve, the fluid is rerouted to the boiler (when it is not needed) and on the other side of the valve, the fluid is routed to a heat exchanger 20 before being returned to the boiler. Reservoir 30 has a refrigerant therein. The reservoir pipes fluid to the heat exchanger 20 wherein it evaporates and forms a high pressure gas. The high pressure gas is used to drive the engine 50, as described below. The gas leaves the engine and passes through a heat exchanger 25 prior to entering a condenser 35. Any gas that does not evaporate can pass through a 1-way return valve to cycle back through the condenser an additional time. A second 1-way valve is provided to prevent backflow into the engine 50. A pump 45 is provided to return condensed liquid back through the heat exchanger 25 and to the reservoir 30.

It is appreciated that the dimensions shown and described herein are preferred dimensions, and that alternative dimensions could be used without departing from the broad aspects of the present invention. Specifically, the engine could be larger or smaller. Also, there could be multiple inlets or outlets (vertically stacked or otherwise arranged), or there could be specifically sized and shaped inlets without departing from the broad aspects of the present invention.

Figure 1:
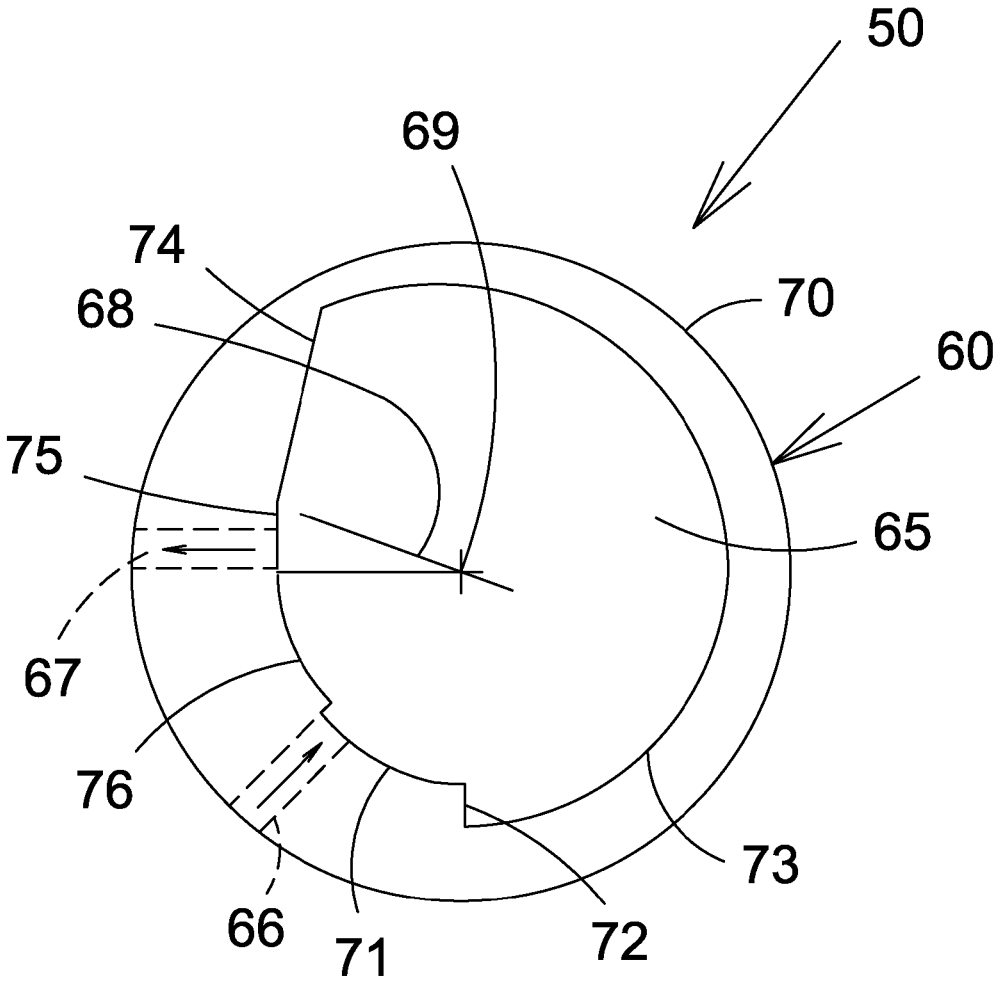
FIG. 1 is a top view of a preferred housing showing the housing profile.

Looking now at FIG. 1, it is seen that the housing 60 has a cavity 65 with an inlet 66 and an outlet 67. The inlet and outlet preferably have a diameter of about 0.375 inches. The housing further has a horizontal centerline. The outlet is preferably located approximately 0.125 inches above the centerline. The outlet could exhaust to atmospheric pressure. Yet, in other embodiments, the outlet 67 could exhaust to a system having pressure other than atmospheric pressure without departing from the broad aspects of the present invention.

The housing 60 has an outer wall 70. The outer wall 70 has an outside diameter of approximately 9 inches. The outer wall 70 preferably has several inner faces 71, 72, 73, 74 75 and 76, as described below moving around the housing 60.

Face 71 is an entrance face. The entrance face preferably is recessed inward approximately 0.250 inch and is preferably 1.75 inches from the outside of the outside surface at the first end of the face. The entrance face preferably has a taper of approximately 0.125 inches along its length, wherein the face is recessed in approximately 0.375 inches and is inward from the outer wall approximately 1.625 inches at the second end. It is preferred that the taper is smooth, constant and continuous.

Face 72 is a ledge face, and drops off radially approximately 0.625 inches. From the entrance face 71. Face 72 is preferably perpendicular to the end of entrance face 71.

Face 73 is a continually radially expanding expansion face. In this regard, the expansion face has a starting thickness of approximately 1 inch. The expansion face has an ending thickness of approximately 0.500 inch. The decrease in diameter from start to end is preferably smooth and continuous.

Face 74 is a return face. A variable sized expansion wall (described below) contacts the return face 74. Return face is preferably flat. The face has a thickness of about 0.500 inches at the start of the face and a thickness of about 1.84 inches at the end of the face. Face 74 lies in a face plane. At the end of the face 74, the angle between the face and a line 68 dissecting the housing 60 through the center 69 is at an angle of approximately 96 degrees. Of course, this angle can be changed without departing from the broad aspects of the present invention. A face in this approximate angle provides a surface that the adjustable expansion wall can slide against without binding.

Face 75 is an exit face, and the outlet 67 is open through this face. Exit face 75 preferably has a flat profile. The exit face lies in an exit face plane. The exit face plane is about 166 degrees from a return face plane that the return face 74 lies in.

Face 76 is an annular face with a constant or uniform thickness of approximately 2 inches. Annular face 76 is between the outlet 66 and the inlet 67. The annular face 76 is preferably approximately 2.5 inches from the center 69 of the cavity 65.

Figure 2:
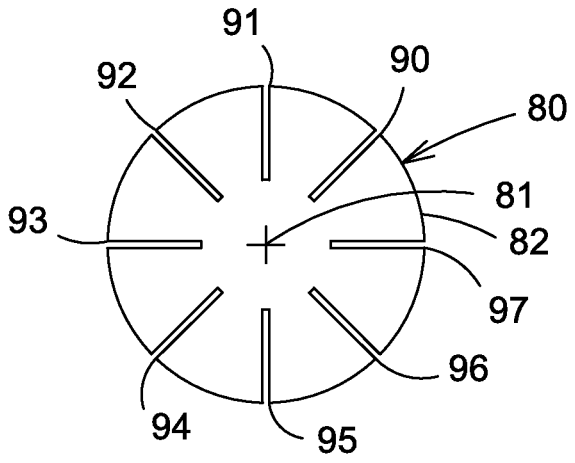
FIG. 2 is a top isolation view of a rotor.

Looking now at FIG. 2, it is seen that a rotor 80 is provided having a center 81 and a perimeter 82. Rotor 80 preferably has a diameter of approximately 5 inches. Eight slots 90, 91, 92, 93, 94, 95, 96 and 97 are spaced equidistantly about the perimeter 82 of the rotor. Each slot preferably has a depth of approximately 1.250 inch. There is preferably a gap of approximately 0.003 inches between the annular face 76 and the rotor 80.

Figure 6:
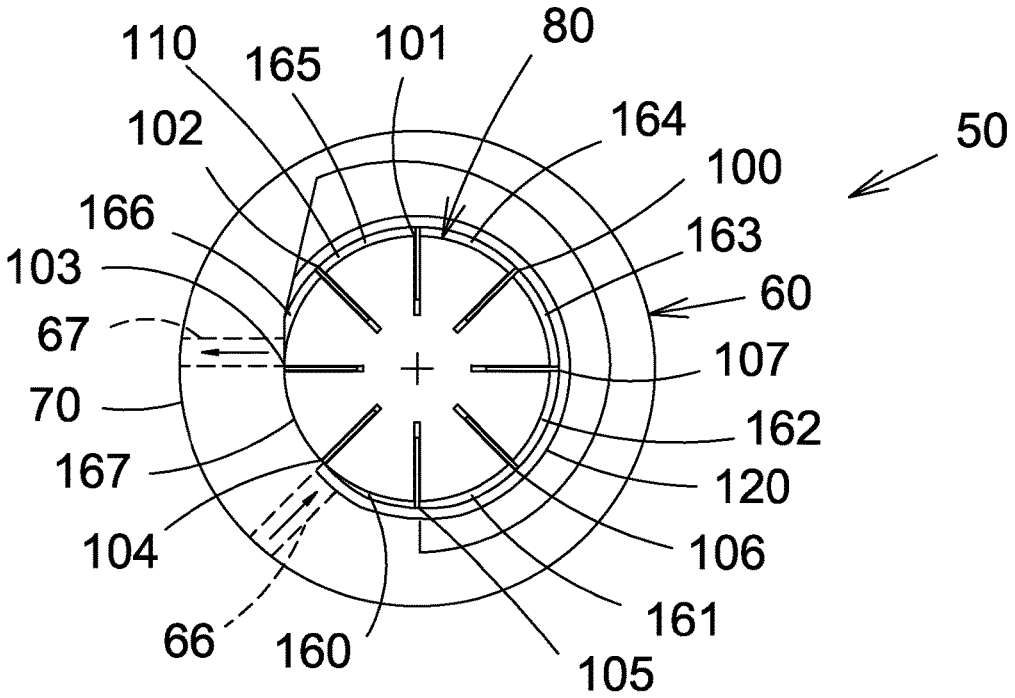
FIG. 6 is similar to FIG. 3 but shows vanes in place.
Figure 7:
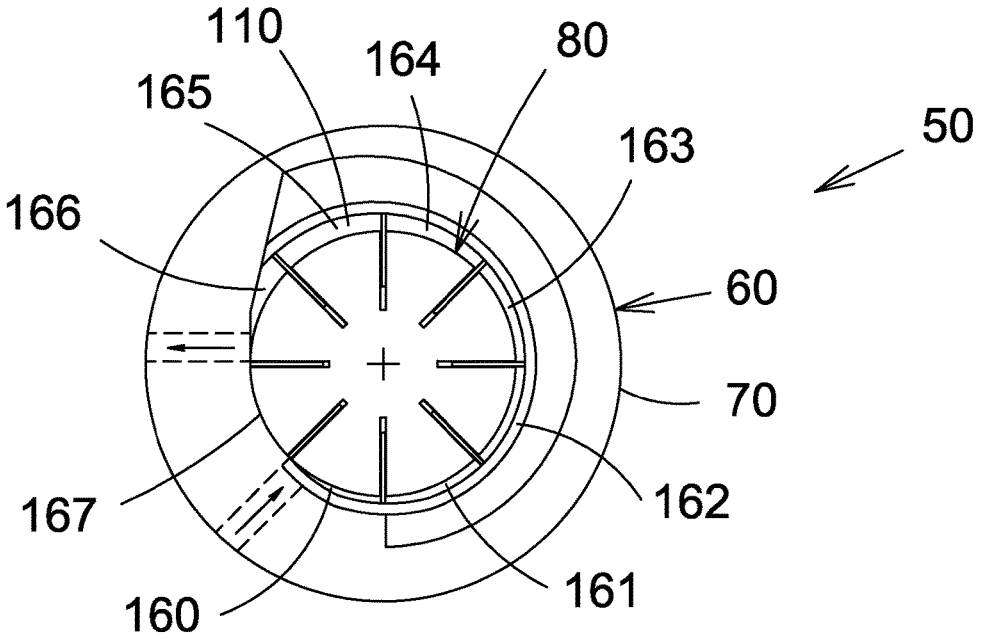
FIG. 7 is similar to FIG. 4 but shows vanes in place.
Figure 8:
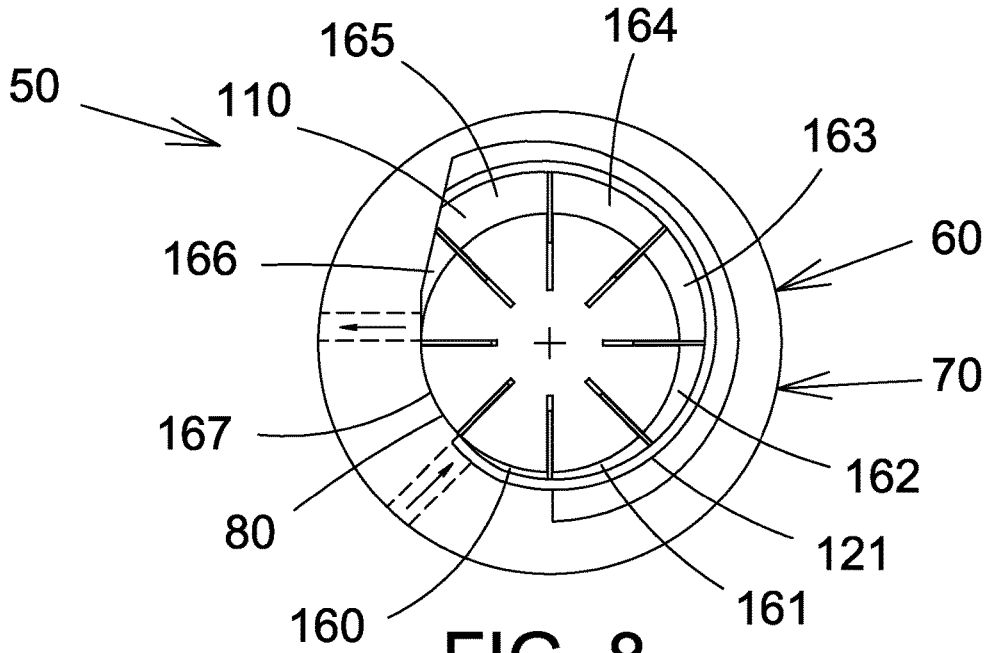
FIG. 8 is similar to FIG. 5 but shows vanes in place.

Vanes 100, 101, 102, 103, 104, 105, 106 and 107 are removably received within slots 90, 91, 92, 93, 94, 95, 96 and 97, respectively, as seen in FIG. 6. Each vane is preferably a spring loaded vane, wherein it is biased to extend from its respective slot until it contacts a surface.

While eight slots and vanes are illustrated herein, it is appreciated that more of fewer vanes and slots may be utilized without departing from the broad aspects of the present invention. Specifically, it is understood that it could be possible to use an engine with a single vane.

Figure 9:
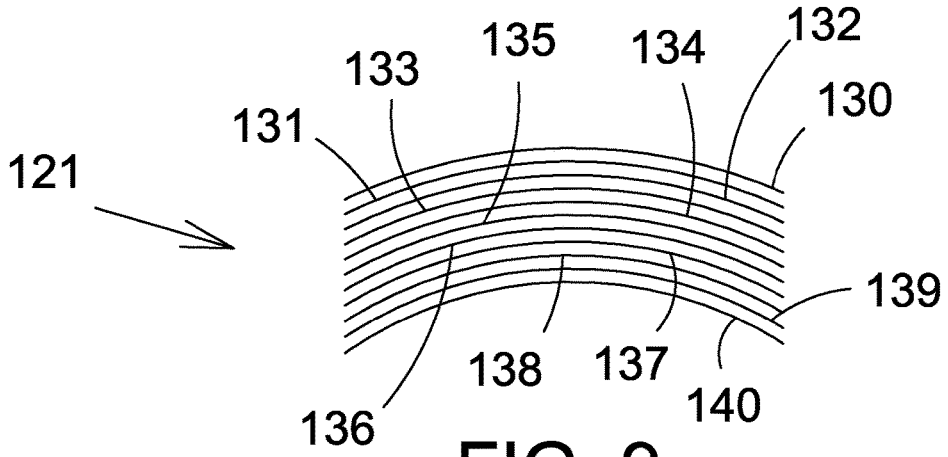
FIG. 9 is a top exploded view of a preferred adjustable chamber wall of the present invention.

An expansion chamber 110 is provided within the cavity 65 between the rotor 80 and an expansion chamber wall 120 (as the rotor turns counter-clockwise within the cavity). The expansion chamber wall has a first end 121, a second end 122, a first side 123 and a second side 124. The chamber wall 120 is preferably formed from spring steel plates 130, 131, 132, 133, 134, 135, 136, 137, 138, 139 and 140 as seen in FIG. 9. The plates are preferably stacked side to side with each plate having a thickness of preferably 0.025 inches.

The first end 121 is preferably secured in a fixed position to the entrance face 71 of the fixed outer wall as seen in FIGS. 3-8. The second end 122 is variably located against the return face 74. The plates slide relative each other and are flexible along their respective lengths. Further, the plates are perpendicularly strong and stiff. The distal plate, being the outermost plate, has an end that is outermost against the return wall. The profile of the stacked plates is that each plate contacts the return wall. The plates are biased to each make contact with the outer wall.

Figure 3:
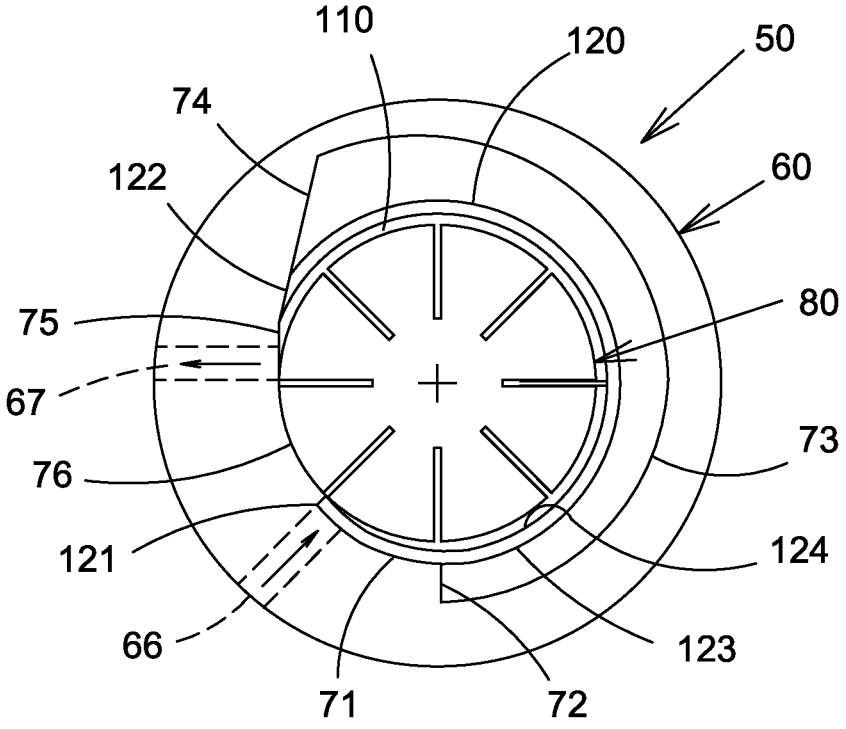
FIG. 3 is a top view of a rotor within an expansion chamber wall in a minimum expansion position.

The minimum expansion position is illustrated in FIG. 3, wherein the expansion chamber starts in the entrance face wherein the thickness of the expansion chamber increases from approximately a 0 inch clearance to 0.125 inches. This thickness is maintained about the housing until the exit face is reached.

Figure 4:
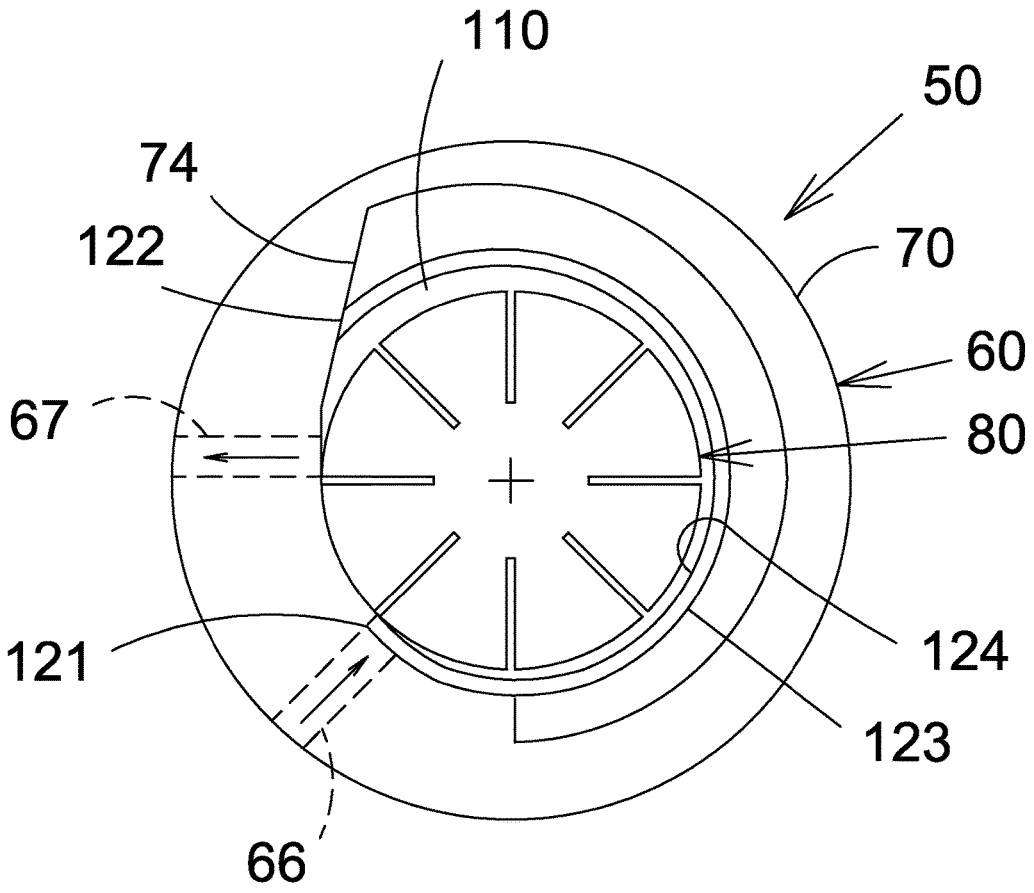
FIG. 4 is similar to FIG. 3, but shows the expansion chamber wall in an intermediate expansion position.

Now looking at FIG. 4, it is seen that an intermediate position is shown. In this example, the expansion wall is 0.125 inches from the rotor at the end of the entrance face. This dimension increases to 0.375 inches at the return wall.

Figure 5:
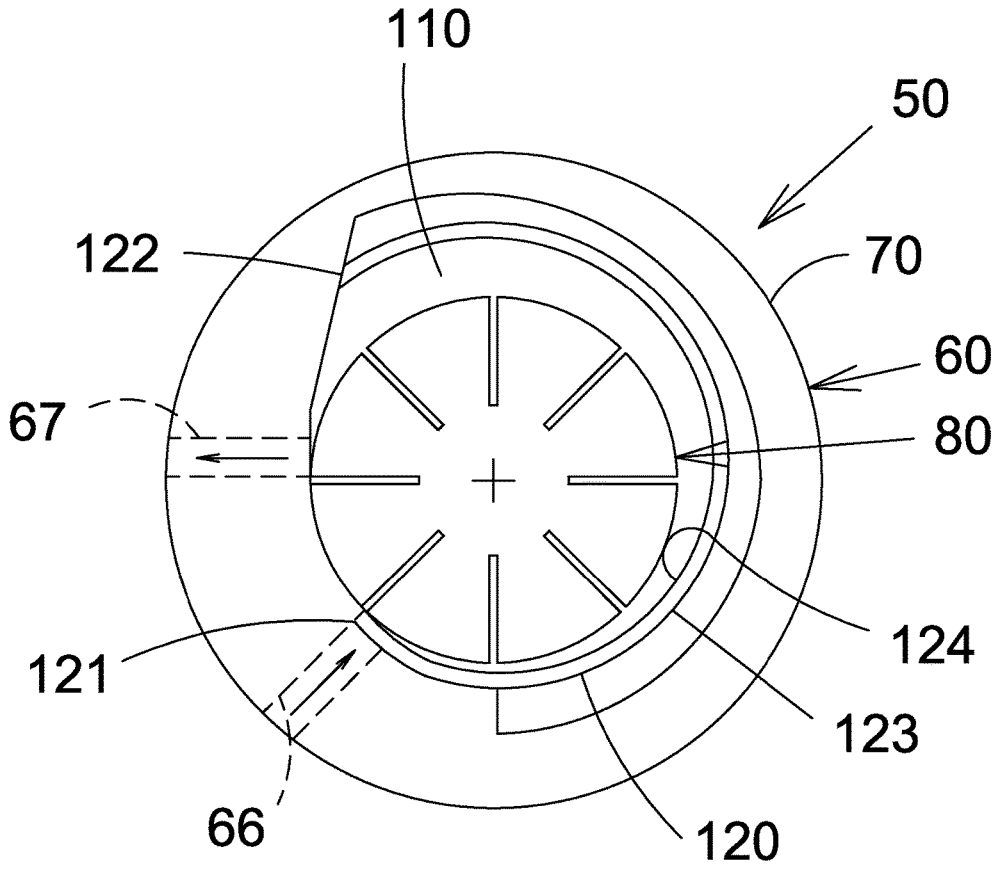
FIG. 5 is similar to FIG. 3, but shows the expansion chamber wall in a maximum expansion position.

Now looking at FIG. 5, it is seen that a maximum position is shown. In this example, the expansion wall is 0.125 inches from the rotor at the end of the entrance face. This dimension increases to 0.625 inches at the return wall.

Hence, it is illustrated that the chamber expands in volume at the entrance face, and either is held constant or increases about the expansion face.

It is appreciated that the vanes remain in contact with the expansion wall 120 regardless of the position of the expansion wall 120 within the cavity 65.

Figure 10:
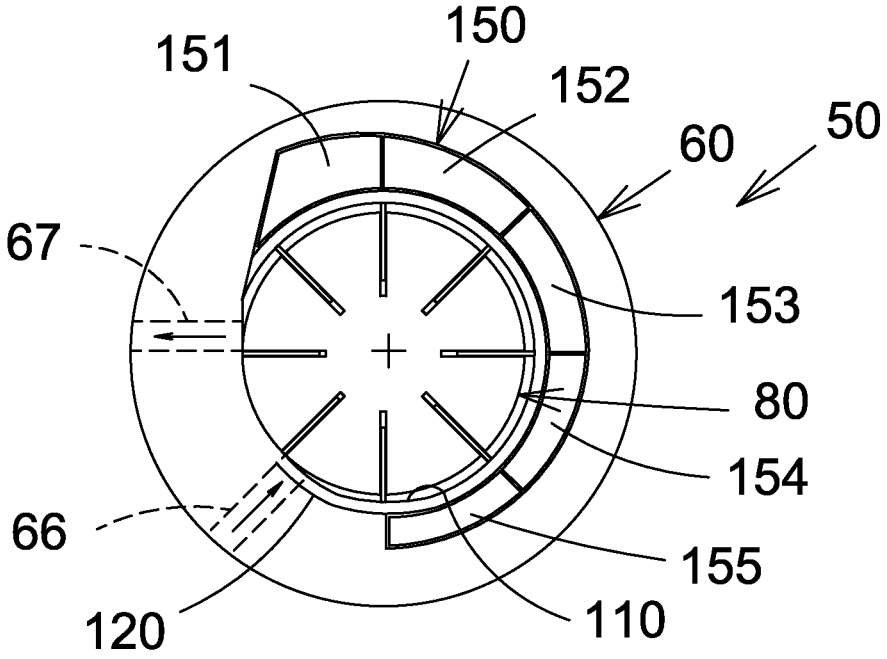
FIG. 10 shows a first preferred embodiment of an adjuster showing the expansion wall in the minimum expansion position.
Figure 11:
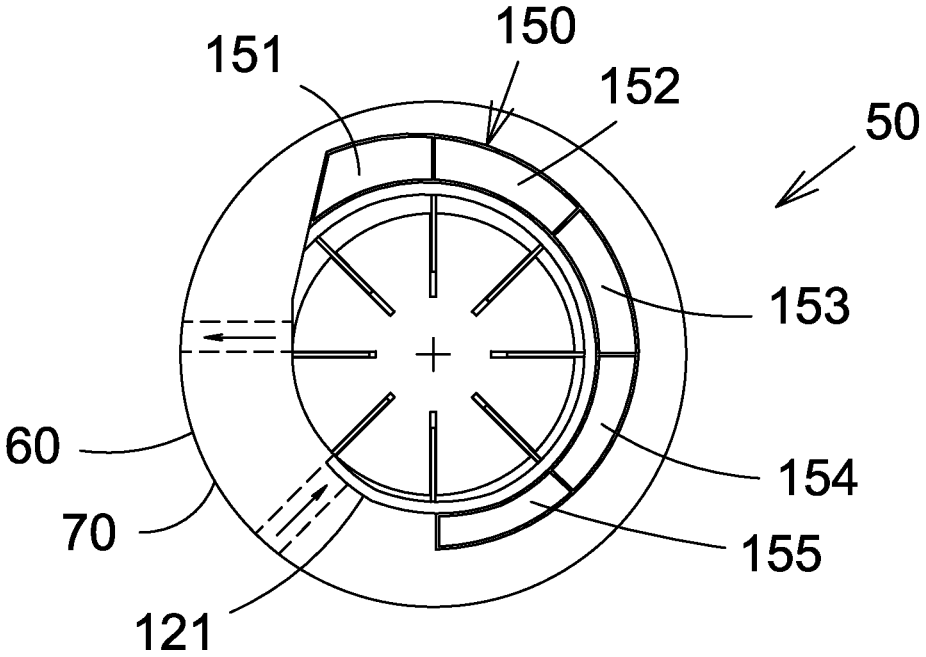
FIG. 11 is similar to FIG. 10, but shows the adjustable wall in an intermediate position.
Figure 12:
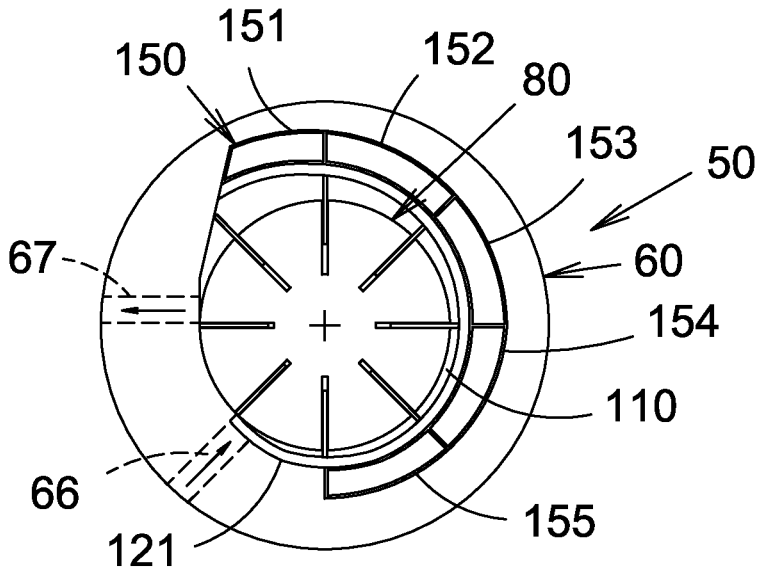
FIG. 12 is similar to FIG. 10, but shows the adjustable wall in a maximum expansion position.

An adjuster 150 having five adjustable fluid tubes 151, 152, 153, 154 and 155 is further provided for adjusting the location of the wall 120 and also for providing support to the backside of the wall as seen in FIG. 10-12. While five tubes are illustrated in this preferred embodiment, it is understood that more or fewer tubes could be used without departing from the broad aspects of the present invention. Each adjustable fluid bag can be connected to a pump to selectably achieve a desired amount of fluid in each tube, and hence determines the location of the wall.

Several compartments 160, 161, 162, 163, 164, 165, 166 and 167 are provided. Each compartment or cavity is bound by the rotor, the expansion wall and two vanes. In this regard, the size or volume of each compartment can change as the rotor rotates (depending on the location of the expansion wall). It is understood that in an embodiment having a single vane, that the vane could form a cavity with the expansion chamber wall, the rotor and an item other than a vane without departing from the broad aspects of the present invention. It is further understood that a single vane embodiment could be used in an embodiment wherein the inlet is controlled with a valve to control the time and duration during which the inlet is opened and closed.

Figure 16:
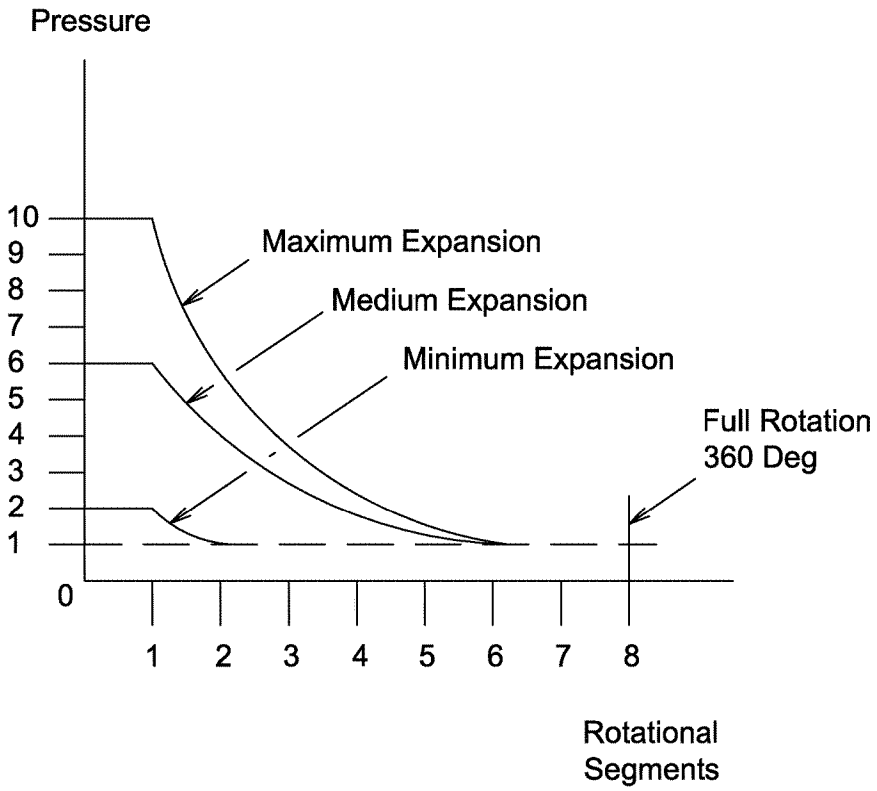
FIG. 16 is a chart showing pressures within a compartment at minimum expansion position, intermediate or middle expansion position, and maximum expansion position.

The expansion of a single compartment or cavity is illustrated in FIG. 16 wherein the expansion is shown when the expansion wall is in the minimum position, an intermediate or middle position, and in the maximum position. In FIG. 16, the pressure is constant in all of the positions as the chamber is open to the inlet. Then, after the chamber passes the inlet, the pressure times volume equation ($P1 \times V1 = P2 \times V2$) determines the slope of the curve as the expansion chamber wall is shown in several positions. This graph assumes a constant temperature according to the ideal gas law. It is understood that if changes in temperature are observed, that the volume of the chamber could be adjusted accordingly whereby cavity pressure approaches or is generally equal to the ambient pressure at the exhaust point.

It is appreciated that the inlet pressure can be changed as well as the volume of the expansion chamber. In the minimum expansion position, the volume expands at the entrance face and is constant around the expansion face. In this regard, the variable in the $P1 \times V1 = P2 \times V2$ equation is P1, which is the inlet pressure. The V1 is the volume at the entrance wall. P2 is the exhaust pressure (which could be atmospheric or otherwise) and V2 is the volume of the chamber at the exhaust. By adjusting the movable wall in and out, the ratio of the input cavity volume/output cavity volume is increased and decreased. This allows the gas to expand in a manner whereby maximum thermodynamic efficiency can be extracted from the system. If the temperature of the gas were to be held constant in accordance with the ideal gas law, $PV = nRT$, then $P1 \times V1 = P2 \times V2$. Further, if known temperature drops do occur, this can be taken into account and the wall can be adjusted in order to increase efficiency.

It is appreciated that at the minimum expansion position, the volume of the chamber is constant as it moves about the expansion face. In this regard, the curve shown at the end of the second segment in FIG. 16 remains constant for the remainder of the rotation to the outlet. In contrast, in a middle position and at the maximum position, as the chamber wall is radially expanding, the pressure continues to decrease as the volume within the chamber increases until the chamber reaches the exit. In each position, for maximum efficiency, the inlet pressure is selected and the adjustable wall is positioned so that the exterior outlet pressure is equal to the pressure within the chamber just as it reaches the outlet.

An inlet pressure gauge 601 and an outlet pressure gauge 602 are provided so that a processor 603 can calculate the respective pressures and make adjustments to the adjustable wall position and inlet pressure as necessary to achieve the desired pressure at the outlet in accordance with the pressure times volume equation as described above. In this regard, the output of the engine is variable as determined by the inlet pressure and adjustable wall position. It is further understood that temperature could be factored into the calculation to determine the proper inlet pressure and adjustable wall position.

Figure 13:
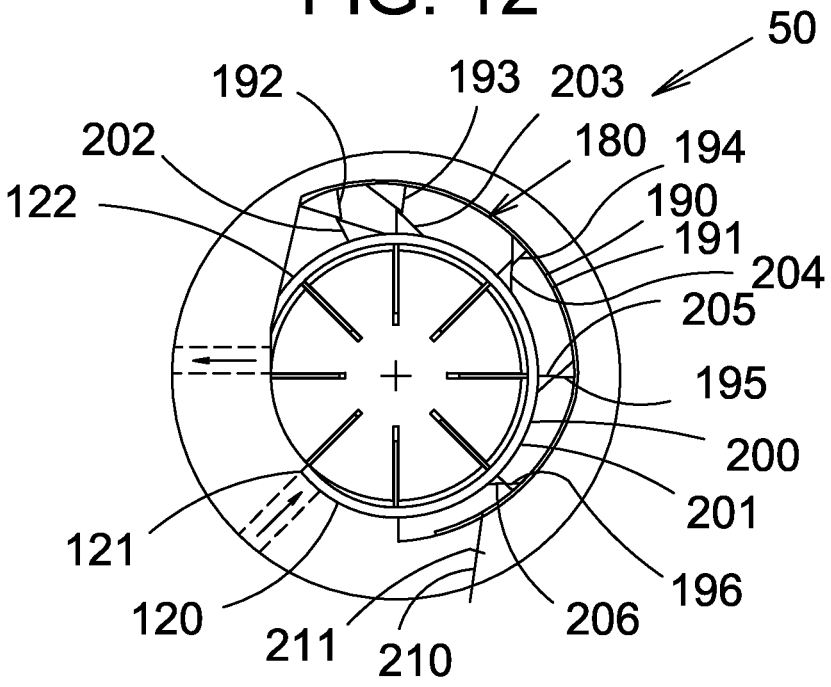
FIG. 13 shows a second preferred embodiment of an adjuster showing the adjustable wall in the minimum expansion position.
Figure 14:
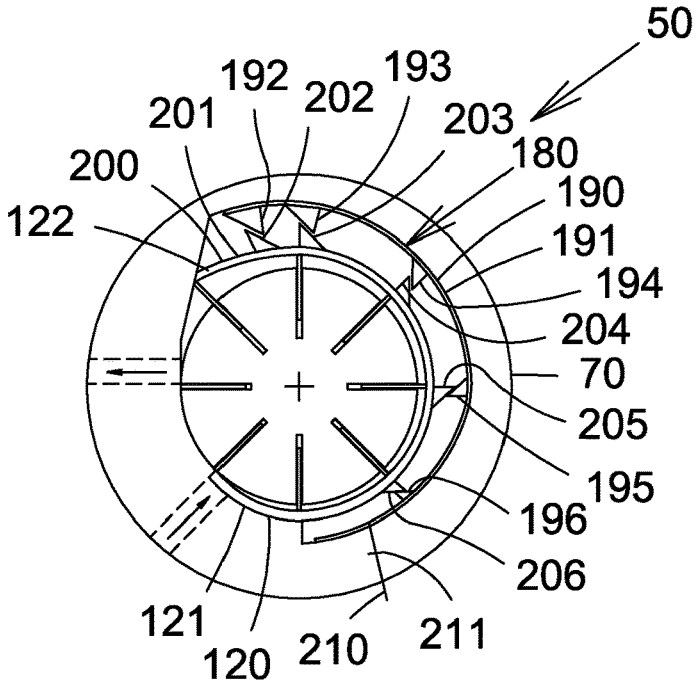
FIG. 14 is similar to FIG. 13, but shows the expansion wall in an intermediate position.
Figure 15:
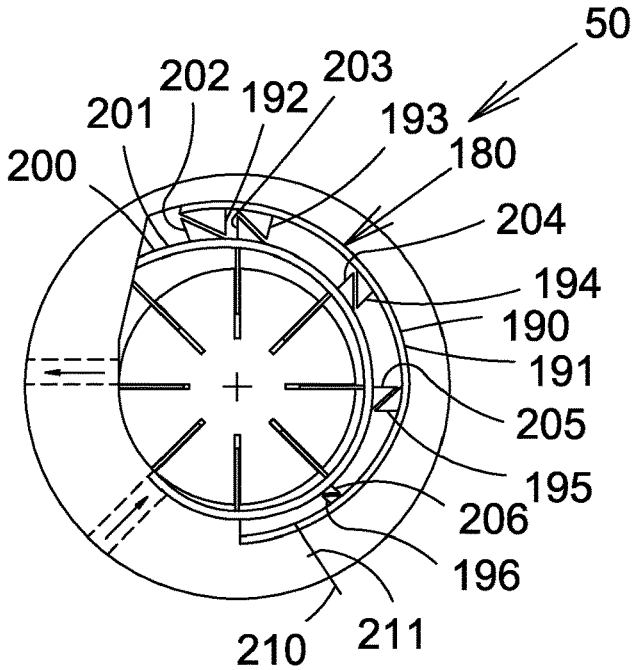
FIG. 15 is similar to FIG. 13, but shows the expansion wall in a maximum expansion position.

Looking now at FIGS. 13-15, it is seen that an alternative adjuster 180 is provided having two pieces 190 and 200, respectively. The first piece 190 has a band 191 with five wedges 192, 193, 194, 195 and 196 thereon. Band is positioned relative to the outer wall. The second piece 200 also has a band 201 and five wedges 202, 203, 204, 205 and 206 thereon. While five wedges are shown on each band, it is appreciated that more or fewer wedges could be used without departing from the broad aspects of the present invention. The band 201 of the second piece is fixed to the expansion chamber wall. The wedges of the first piece 190 cooperate with the wedges of the second piece 200, wherein the distance between the bands 191 and 201 increase and decrease as the wedges ride up or down each other.

A control 210 with a fulcrum 211 is provided. Rotation of the control 210 about the fulcrum 211 causes the first piece 190 to move relative to the second piece 200 and hence cause the wedges to ride up or down each other. It is appreciated that the slope of the wedges is lowest near the ledge face 72 and greatest near the return face 74. Hence, per unit of lateral band travel, the bands separate the farthest near the return face.

It is appreciated that adjustable expansion does not require constant expansion. In one position, the chamber expands only at the inlet face and is constant about the expansion face. The rate of increase of volume could also change to achieve a desired power output of the engine in response to a change in the ratio of input pressure to output pressure, or input/output pressure ratio.

Figure 18:
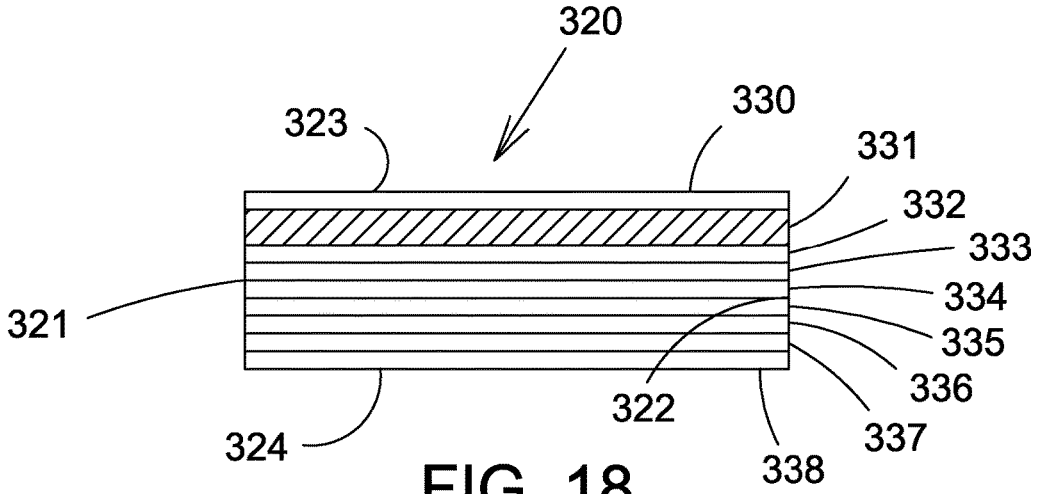
FIG. 18 is a side view of an alternative adjustable wall of the present invention.
Figure 19:
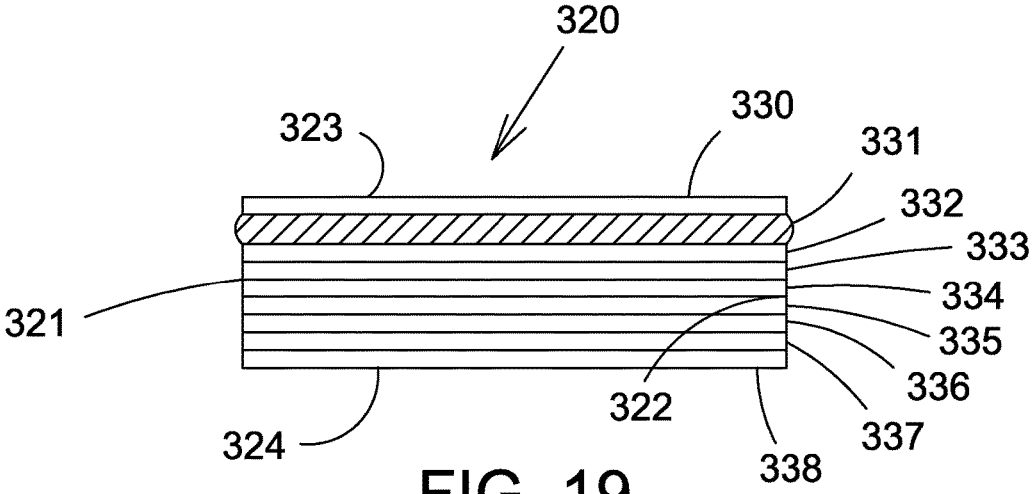
FIG. 19 is similar to FIG. 18, but shows the adjustable wall under a load condition with the seal expanded.

Looking now to FIGS. 18 and 19, it is seen that an alternative adjustable wall 320 is provided. The wall 320 has ends 321 and 322. The wall 320 also has sides 323 and 324. The chamber wall 320 is preferably formed from spring steel plates 330, 332, 333, 334, 335, 336, 337 and 338. The plates are preferably stacked side to side. Plates 330 and 332-338 each preferably have a thickness of 0.025 inches. A seal 331 is preferably made of a compressible material such as rubber or a low friction material. In this regard, upon compression of the adjustable wall, the seal 331 can extend laterally outwards to make an improved (greater force of contact as the compressible material has a slight bulge) seal with the fixed outer wall. It is appreciated that while nine plates are illustrated, that more or fewer plates could be used without departing from the broad aspects of the present invention. Further, while the second plate from a side is shown to be compressible, any of the interior plates could be compressible and there could be more than one compressible plate without departing from the broad aspects of the present invention.

Figure 20:
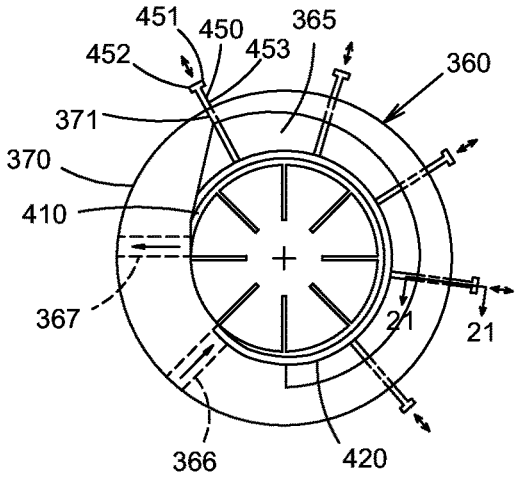
FIG. 20 is a top view of an alternative embodiment of the present invention.
Figure 21:
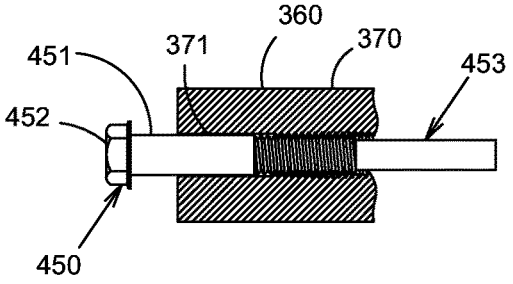
FIG. 21 is a cross-sectional view taken along line 21-21 in FIG. 20.

Looking now to FIGS. 20 and 21, it is seen that an alternative adjuster 450 for a housing 360 is provided. In this regard, the housing 360 has a cavity 365 with an inlet 366 and an outlet 367. A fixed outer wall 370 is provided with at least one hole 371 there through (preferably five holes). An expansion chamber 410 with an adjustable wall 420 is further provided. The adjuster 450 has at least one screw 451 (preferably five screws). The screw 451 has a head 452 and a body 453. The screw can be manually operated or operated by a motor thereby applying force on the back side of the expansion wall selectably moving it inward or outward radially. The wall can be adjusted for maximum efficiency or for a desired power output.

Figure 20A:
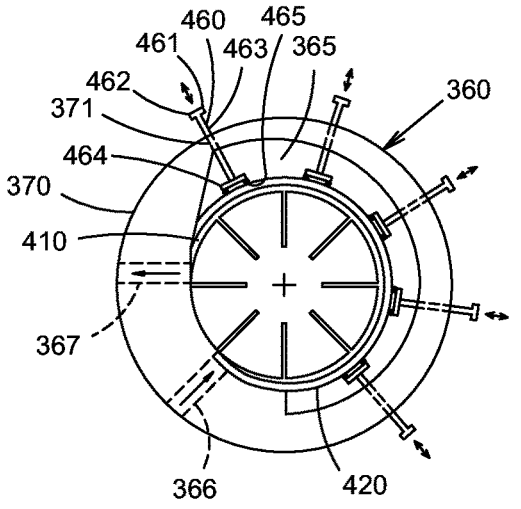
FIG. 20A is similar to FIG. 20 but shows a further embodiment of the present invention.

Looking now to FIG. 20A, it is seen that a further preferred embodiment of the present invention is illustrated. In particular, an alternative mechanical adjuster 460 is illustrated. The mechanical adjuster 460 has a screw 461 with a head 462 and a body 463. A foot 464 is provided having two contacts 465. The contacts 465 are preferably round and can apply pressure at both ends of the foot 464. In this regard, there are two pressure points from each adjuster that cuts the point load stresses in half. It is preferred that the contacts 465 span the entire length, height, or dimension of the adjustable wall. In this regard, the contacts preferably have a cylindrical shape with lengths equal to the wall dimension.

It is appreciated that in this embodiment, as well as in the other embodiments, that there can be more or fewer adjusters without departing from the broad aspects of the present invention.

Figure 22:
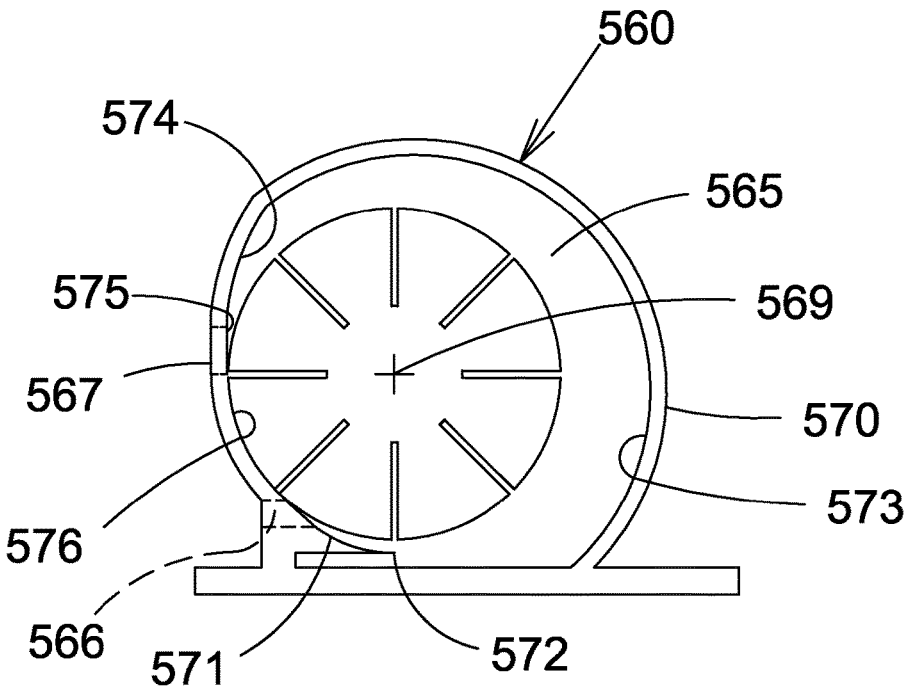
FIG. 22 is a view showing an alternative embodiment of the present invention.
Figure 23:
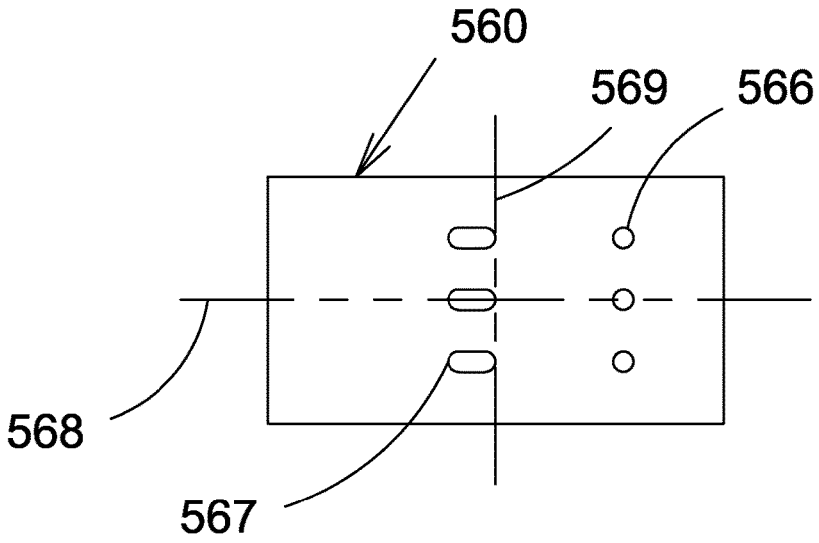
FIG. 23 is a side view of the alternative embodiment illustrated in FIG. 22.

Looking now at FIGS. 22 and 23, it is seen that an alternative embodiment of the present invention is illustrated. In particular, it is seen that an alternative housing 560 is provided having a cavity 565 with an inlet 566 and an outlet 567. The inlet 566 is preferably generally round. However the inlet in an alternative embodiment could be generally elongated in that it could resemble a slot that is wider in one dimension or have other shapes without departing from the broad aspects of the present invention. The outlet 567 is preferably generally elongated but could be round or have another shape without departing from the broad aspects of the present invention. A horizontal center line 568 and a center 569 are shown. As seen in FIG. 23, there can be three inlets and outlets. However, it is understood that there could be more or fewer inlets and outlets without departing from the broad aspects of the present invention.

The housing 560 has a fixed outer wall 570. The fixed outer wall 570 has an entrance face 571, a transition point 572 (where the entrance face would meet an expansion chamber wall), an expansion face 573, a return face 574, an exit face 575 and an annular face 576. The return face 574 preferably follows a curved path. In this regard, the end of the expansion wall engages the face along the curved path ensuring smooth operation thereof.

Thus it is apparent that there has been provided, in accordance with the invention, a vane heat engine that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A vane motor comprising:

a housing comprising a fixed outer wall having:

an entrance face;

a ledge face;

an expansion face;

a return face;

an exit face; and an annular face;

a rotor;

an expansion chamber wall, said expansion chamber wall having an axial length wherein said expansion chamber wall is flexible along the axial length, said expansion chamber wall being fixed in position relative to said entrance face and variable in position relative to said return face.

2. The vane motor of claim 1 wherein said motor further comprises an adjuster adjusting the position of said expansion chamber wall relative to said rotor.

3. The vane motor of claim 1 wherein said expansion chamber wall is comprised of a plurality of plates, said plurality of plates having respective second ends, said respective second ends being movable relative to each other.

4. A vane motor for a gas, said vane motor comprising:

a housing with a fixed outer wall having a return face;

a rotor, said fixed outer wall being in a fixed position with respect to said rotor;

a first vane and a second vane; and an expansion chamber wall defining an expansion chamber between said expansion chamber wall and said rotor, said expansion chamber wall being movably adjustable between said rotor and said fixed outer wall wherein said expansion chamber has a volume that is adjustable and a ratio of input volume to output volume that is adjustable via adjustment of said expansion chamber wall, and said expansion chamber wall having a distal end contacting said return face at a variable position to adjust said volume of said expansion chamber, wherein an amount of said gas enters said vane motor at a high pressure, said gas expands within said expansion chamber and said gas exits said vane motor at a low pressure.

5. The vane motor of claim 4 wherein:

said fixed outer wall further has:

an entrance face;

a ledge face;

an expansion face;

an exit face; and an annular face; and said expansion chamber wall is fixed in position relative to said entrance face and variable in position relative to said return face.

6. The vane motor of claim 4 wherein said expansion chamber has an axial length, and said expansion chamber either expands in volume or has a constant volume along its axial length.

7. The vane motor of claim 4 wherein the low pressure is generally equal to an ambient pressure of an environment to which said gas is exhausted into.

8. A vane motor comprising:

a housing;

a rotor;

at least one vane; and an expansion chamber wall being comprised of a plurality of plates, said expansion chamber wall being adjustable relative to said rotor by having a variable position within said housing in relation to said rotor.

9. A vane motor comprising:

a housing;

a rotor;

an expansion chamber wall, said expansion chamber wall having an axial length wherein said expansion chamber wall is flexible along the axial length, wherein said expansion chamber wall is comprised of a plurality of plates, said plurality of plates having respective second ends, said respective second ends being movable relative to each other.

* * * * *